US007748815B2

(12) United States Patent
Anderson et al.

(10) Patent No.: US 7,748,815 B2
(45) Date of Patent: Jul. 6, 2010

(54) DISABLING A NOZZLE

(75) Inventors: Daryl E. Anderson, Corvallis, OR (US); Mark Hunter, Portland, OR (US); Scott A. Linn, Corvallis, OR (US); Richard R. Clark, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 571 days.

(21) Appl. No.: 11/890,600

(22) Filed: Aug. 6, 2007

(65) Prior Publication Data

US 2009/0040260 A1 Feb. 12, 2009

(51) Int. Cl.
*B41J 29/393* (2006.01)

(52) U.S. Cl. ..... 347/19

(58) Field of Classification Search ..... 347/14, 347/19; 358/504
See application file for complete search history.

(56) References Cited

U.S. PATENT DOCUMENTS 4,439,776 A 3/1984 Zeiler
5,432,337 A 7/1995 Kato et al.
5,736,997 A 4/1998 Bolash et al.
6,037,831 A 3/2000 Watrobski et al.
6,081,280 A 6/2000 Bolash et al.
6,199,969 B1 3/2001 Haflinger et al.
6,471,324 B1 10/2002 Maru
6,520,615 B1 2/2003 Beck et al.
6,758,547 B2 * 7/2004 Ahne et al. ..... 347/19
7,014,290 B2 3/2006 Chen et al.
7,237,865 B2 * 7/2007 Hara ..... 347/19
7,438,376 B2 * 10/2008 Tamura et al. ..... 347/17
7,547,087 B2 * 6/2009 Cato et al. ..... 347/19
2005/0231538 A1 10/2005 Deng

OTHER PUBLICATIONS

International Search Report for Application No. PCT/US2008/072102. Report issued Dec. 9, 2008.

* cited by examiner

*Primary Examiner*—Lamson D Nguyen

(57) ABSTRACT

Embodiments of nozzle disable systems and methods are disclosed.

22 Claims, 5 Drawing Sheets

DISABLING A NOZZLE

BACKGROUND

Ink-jet printing is typically accomplished using one of two technologies, thermal ink-jet and piezoelectric ink-jet printing. In thermal ink-jet printing, a print head has an array of nozzles. Each nozzle typically includes a heater element that is used to vaporize the ink and push out an ink bubble of a predetermined size onto the paper.

Typically, as the number of nozzles increase and the size of the bubbles decrease, the limitations and tolerances of the print head become more demanding. The high tolerances used to produce the print head can lead to manufacturing defects which can cause one or more of the heater elements to be electrically shorted. Other effects can also cause shorting of heating elements, including ink buildup within the nozzle. Shorting of heating elements within the nozzles can reduce the quality of the output from the printer. Also, electrical shorts can cause failure of the heating element or in some cases, a cascade failure of the entire print head or printer may occur.

BRIEF DESCRIPTION OF THE DRAWINGS

Features and advantages of the present disclosure will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

The present disclosure is drawn to systems and methods for detecting and/or ameliorating the effects of an electrical short in one or more heating element(s). Typically, when a short in the print head is detected, the entire print head, or a significant portion of the print head is shut down. Shutting down the print head, or a portion thereof, can stop or substantially slow printing. Further, some shorts in the print head can involve a relatively expensive solution, such as the purchase of a new print head.

In accordance with embodiments of the present disclosure, it has been recognized that a system and method is used for disabling a single nozzle having a shorted heater element in a thermal ink-jet print head. The ability to detect a short and disable a single nozzle associated with a shorted heater element enables a print head to continue to be used even when one or more shorts have been detected. Additionally, an adjacent nozzle to the disabled nozzle may be used to limit or eliminate deleterious affects caused by the disabled nozzle. Thus, detecting a short in one or more heater element(s) and disabling the shorted heater element(s) in a thermal inkjet print head (without disabling other heater elements) can reduce or eliminate the negative affects on printing caused by the shorted heater elements. Moreover, rapid detection and disablement of an electrically shorted heater element can save the heater element from being damaged, and additionally, the entire print head and printer from being damaged as well.

Figure 1:
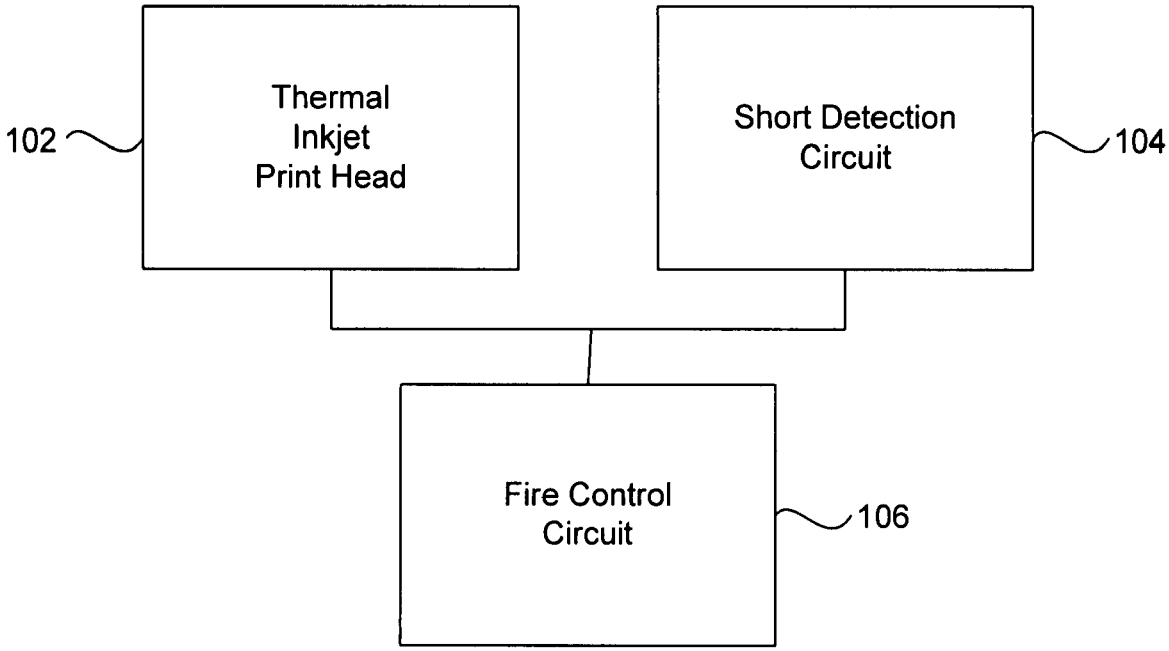
FIG. 1 is an illustration of a block diagram for detecting a short circuit in a heater element in a thermal ink-jet print head nozzle in accordance with an embodiment of the present disclosure.
Figure 2:
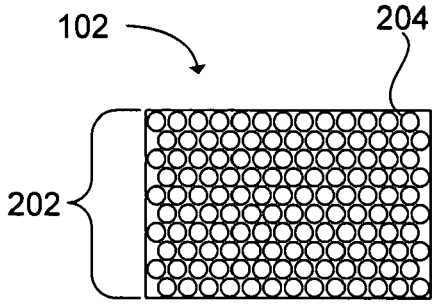
FIG. 2 is an illustration of an embodiment of a thermal ink-jet print head having an array of nozzles.

FIG. 1 shows one example embodiment of a block diagram for detecting a short circuit in a heater element in a thermal ink-jet print head nozzle. The block diagram includes a thermal ink-jet print head 102. The thermal ink-jet print head can include an array of nozzles 202, as shown in FIG. 2. A heater element (not shown) can be coupled to a single nozzle 204 in the array of nozzles. In one embodiment, each of the nozzles in the array can be coupled to a separate heater element. Alternatively, a plurality of the nozzles can each be coupled to a separate heater element and one or more of the nozzles in the array may not include a heater element. The heater element can be located within the nozzle or adjacent to the nozzle so long as the element is sufficiently close to heat ink within the nozzle to a desired temperature within a predetermined amount of time, as can be appreciated. In one embodiment, the heater element can be a heater resistor configured to resistively heat ink within the nozzle when current is passed through the heater resistor.

Returning FIG. 1, a short detection circuit 104 is configured to detect a short circuit in a heater element. A short circuit can be detected in the heater element by measuring one of the current and voltage in the heater element. When the measured current is greater than a predetermined value, or the measured voltage is less than a desired amount, it can be determined that the heater element is at least partially shorted to ground.

The heater element may be shorted to ground due to a variety of circumstances. For example, a thermal ink-jet print head 102 is typically manufactured with a number of different layers using lithographic processes. Errors in manufacturing can cause the heater element to become shorted to a ground layer within the print head. In another example, dust or ink particles may become lodged within a nozzle 204 and cause the heater resistor to become shorted to ground. Additionally, a power surge from an external power supply may cause damage within the heater resistor, nozzle, or some other portion of the print head that can cause shorts. A variety of other incidents can also occur that can cause a short in one or more of the heater elements in the print head.

Once a short circuit has been detected, a signal can be sent from the short detection circuit 104 to a fire control circuit 106. The short detection circuit and the fire control circuit can be attached to the print head. Alternatively, the short detection circuit and the fire control circuit may be located at a separate location and electrically coupled to the print head.

The fire control circuit can be used to control when ink is ejected from one or more of the nozzles 204 in the array of nozzles 202 in the print head 102. For example, each heater element may be connected to a latch such as a data latch 302. The data latch can be used to control when a pulse of current is sent through a heater element to cause the heater element to resistively heat and eject a portion of ink from the nozzle to which the heater element ins coupled.

In one embodiment, a digital high, or "1", can be sent to the D input of the data latch 302 when it is desired that a nozzle should be fired. An enable signal can then be sent to the E input to enable the nozzle to fire. All of the desired nozzles may be fired at the same time by synchronously sending the enable signal to all of the latches at the same time. Alternatively, the nozzles may be fired in a selected pattern, or selected nozzles may be fired independently of other nozzles.

When the pulse of current is sent to the heater resistor associated with a specific nozzle, the current or voltage can be measured, as previously discussed. When the measurement of a selected heater resistor associated with a single nozzle 204 is outside of a selected boundary, a signal from the short detection circuit 104 can be sent to the fire control circuit 106 to reset the data latch 302. This may be done by holding the enable line at the "CLR" input of the data latch low or sending a digital low, or "0" to the D input to clear the latch. Each heater resistor in the array of nozzles 202 can be coupled to a short detection circuit and a fire control circuit. Of course, the data latch is one of a variety of ways to control the firing of the heater resistors in the nozzle array. Different types of digital or analog circuitry may be used to enable the firing of the heater resistor to be controlled, as can be appreciated.

When one or more heater resistors are measured to be outside the selected limits by the short detection circuit 104, a signal can be sent to the data latch 302 in the fire control circuit 106, thus disabling the shorted heater resistor from being fired. In one embodiment, a selected heater resistor may be permanently disabled when it is determined that the heater resistor is shorted to ground. In another embodiment, each of the heater resistors can be measured each time before the heater resistor is fired. This enables nozzles to be used again when the cause of the short circuit in the heater resistor associated with the nozzle was temporary, such as a power spike.

Figure 4:
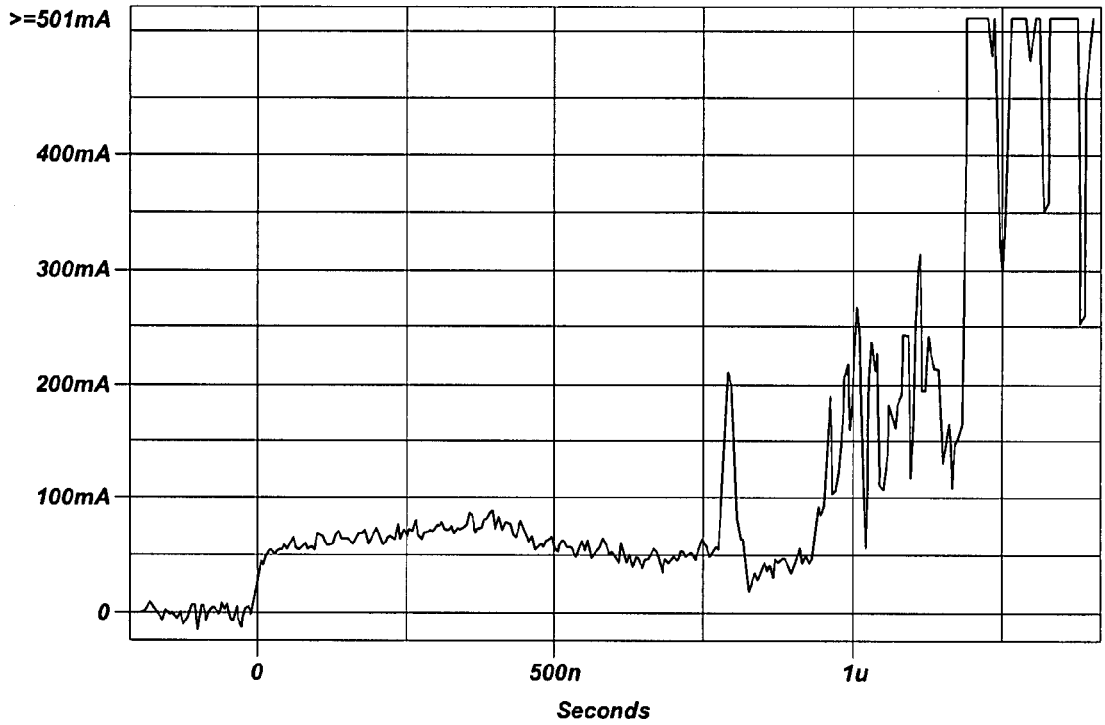
FIG. 4 is a graph illustrating a measurement of the current in a heater resistor when a short circuit has occurred with no short detection/disable circuit in accordance with an embodiment of the present disclosure.

FIG. 4 illustrates a measurement of the current in a heater resistor when a short circuit has occurred. A typical value of a current level in the heater resistor is approximately zero when the heater resistor is off and can be about 50 milliamps (mA) when the circuit is turned on, or fired. Variations in power input and manufacturing can vary the actual current in each heater resistor. However, the current is typically less than 90 milliamps during a firing.

In one embodiment, it can be seen in the graph that a current spike occurs approximately 775 nanoseconds (ns) after the measurement begins. The short circuit causes the control electronics to saturate at a level of over 500 mA at a voltage of 32.25 volts. At this power level the heater resistor, nozzle, controlling electronics, and ink-jet head can quickly be damaged.

Figure 5:
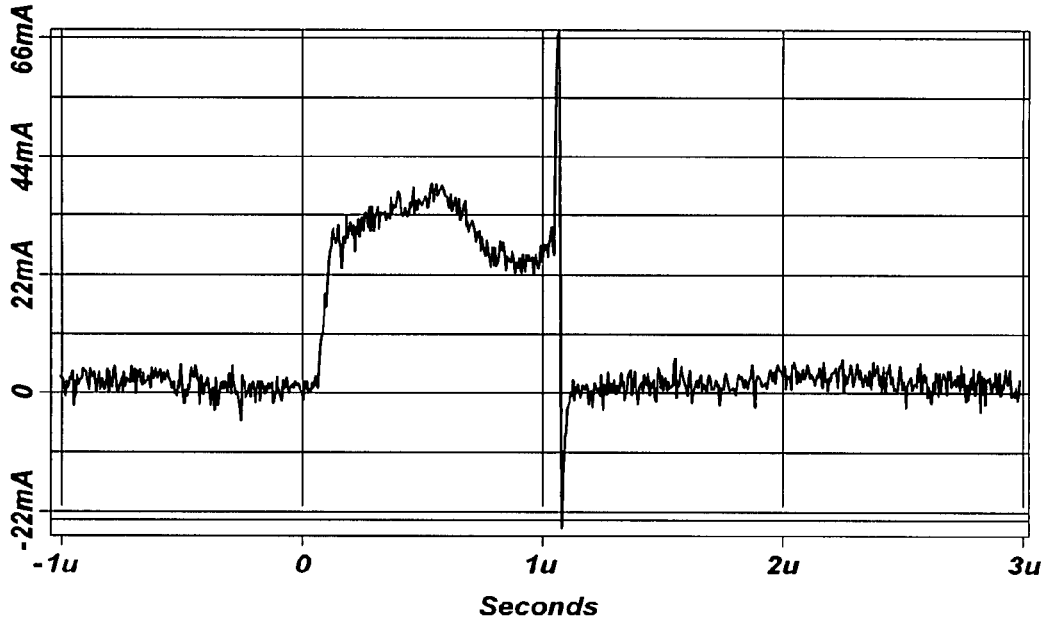
FIG. 5 is a graph illustrating a measurement of the current in an embodiment of a heater resistor when an embodiment of a short detection circuit is implemented using a current sense resistor.

FIG. 5 illustrates a measurement of the current in a heater resistor of one embodiment when the short detection circuit 104 of FIG. 1 is implemented using a current sense resistor. FIG. 5 shows that when the heater resistor is fired the current increases to approximately 70 mA for less than a microsecond. The current then spikes, indicating a short circuit has occurred, and the circuit detected the short and cleared the fire control data latch to turn off power to the heater resistor, which then returned to approximately zero mA. The heater resistor was turned off less than 50 ns after the short occurred using a current sense resistor to measure current flowing through the heater resistor.

Figure 6:
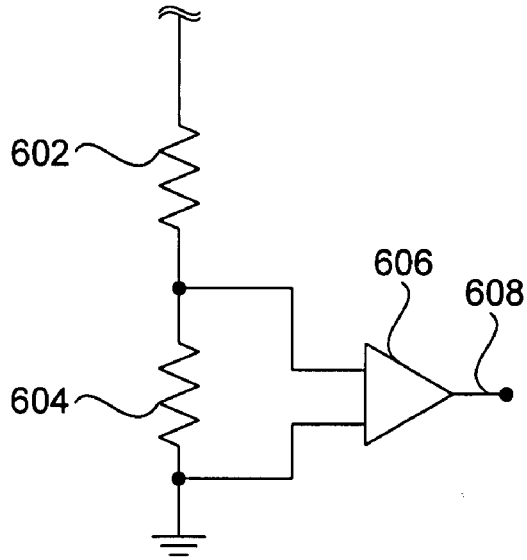
FIG. 6 is an illustration of a short detection circuit configured to measure current using a current sense resistor in accordance with an embodiment of the present disclosure.

An example short detection circuit configured to measure current using a current sense resistor is shown in FIG. 6. Current can be input to the heater resistor 602. A current sense resistor 604 can be located in series with the heater resistor in a ground return leg of the heater resistor. The current sense resistor produces a voltage drop when the heater resistor is fired. The resulting differential voltage across the sense resistor can be monitored by a differential sense amplifier 606.

Figure 3:
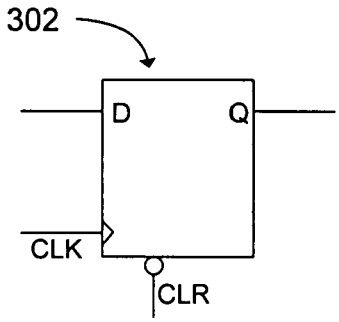
FIG. 3 is an illustration of a fire control data latch in accordance with an embodiment of the present disclosure.

The sense amplifier 606 can be tuned to trip, indicating a short, when the sense resistor differential voltage exceeds a predetermined threshold. For example, in one embodiment, the sense amplifier may be tuned to trip at a level greater than 90 mA. The current sense resistor may have a value of around 5 ohms. Of course, a range of values around the example values may be expected due to limits in manufacturing tolerances. The output 608 of the sense amplifier can be sent to the fire control circuit 106 (FIG. 1). In one embodiment, the output can clear the fire control data latch 302 (FIG. 3). Clearing the fire control data latch can stop substantially any current from flowing through the heater resistor 602.

Figure 7:
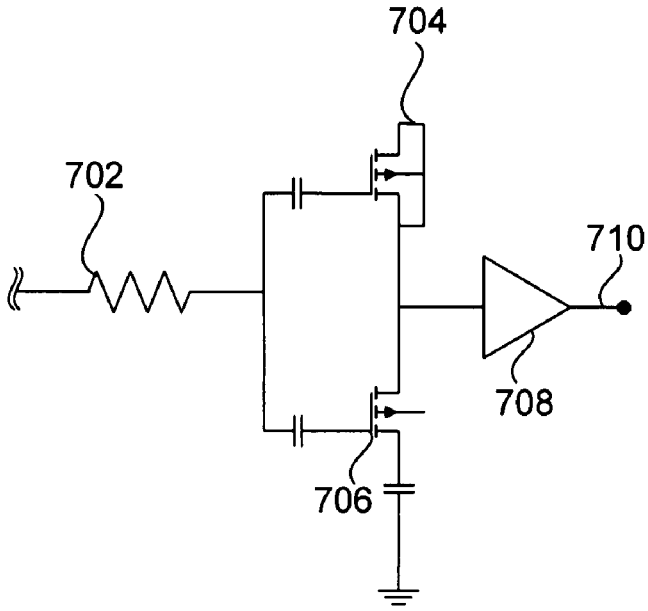
FIG. 7 is an illustration of a short detection circuit configured to measure voltage using a voltage divider in accordance with an embodiment of the present disclosure.

In another embodiment, the short detection circuit can be configured to measure voltage. For example, the voltage on a high side of the heater resistor 702 can be sensed by a voltage divider circuit, as shown in FIG. 7. Two Metal Oxide Semiconductor (MOS) devices 704 and 706 can form a voltage divider. The output of the voltage divider produces a voltage that is proportional to the voltage being sensed. If the voltage being sensed is low enough, indicating a short circuit, then an output signal 710 can be generated by an amplifier 708 that forms a tuned inverter. The output signal can be sent to the short detection circuit 106 (FIG. 1). In one embodiment, the output can clear the fire control data latch 302 (FIG. 3). Clearing the fire control data latch can stop substantially any current from flowing through the heater resistor.

Figure 8:
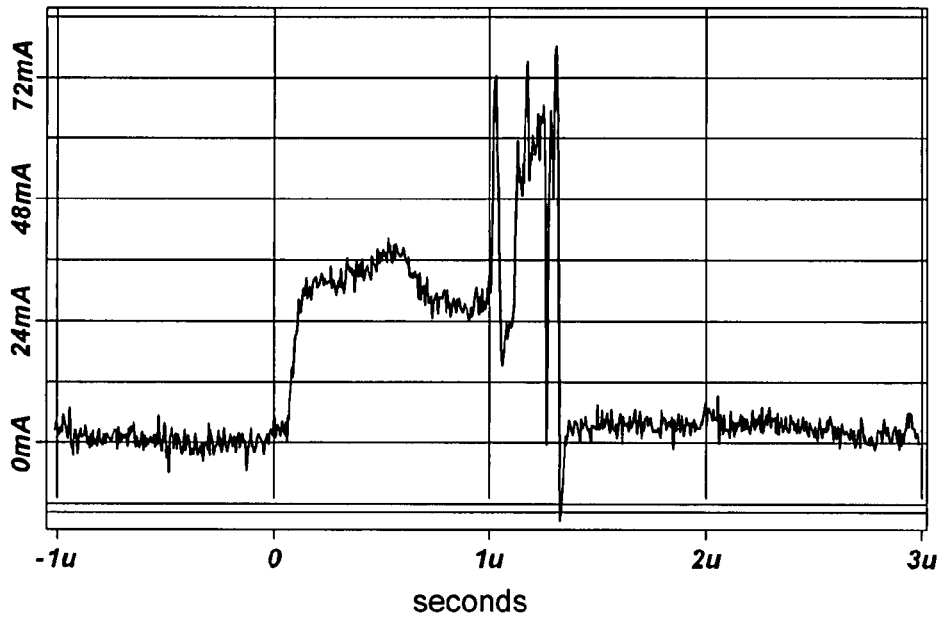
FIG. 8 is a graph illustrating a measurement of the current in the heater resistor when a short detection circuit is implemented using a voltage divider in accordance with an embodiment of the present disclosure.

FIG. 8 illustrates a measurement of the current in a heater resistor when the short detection circuit 104 of FIG. 1 is implemented using a voltage divider, as shown in FIG. 7. FIG. 8 shows that the current increased to about 70 mA when the heater resistor was fired. After about 1 microsecond a short circuit occurred and the current spiked to over 145 mA. The short circuit was detected and an output signal was sent from the voltage divider circuit (FIG. 7) to clear the fire control data latch 302 (FIG. 3). The current level returned to approximately zero miliamps after about 200 ns, illustrating that power to the heater resistor was turned off.

Figure 9:
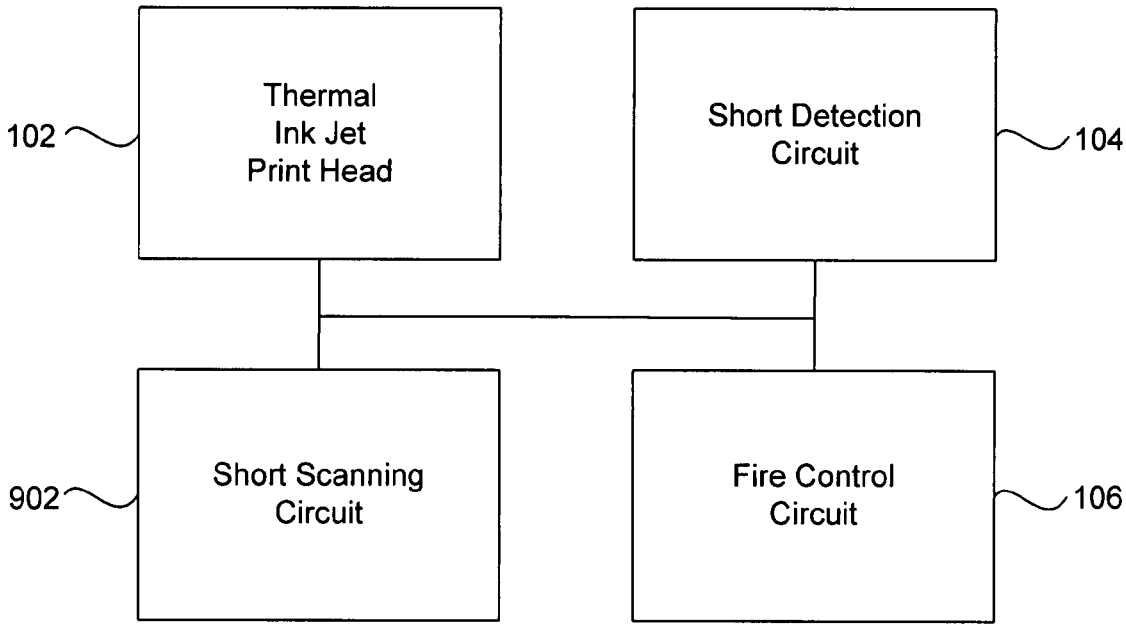
FIG. 9 is an illustration of a block diagram for detecting a short circuit in a heater element in a thermal ink-jet print head nozzle including a short scanning circuit in accordance with an embodiment of the present disclosure.
Figure 10:
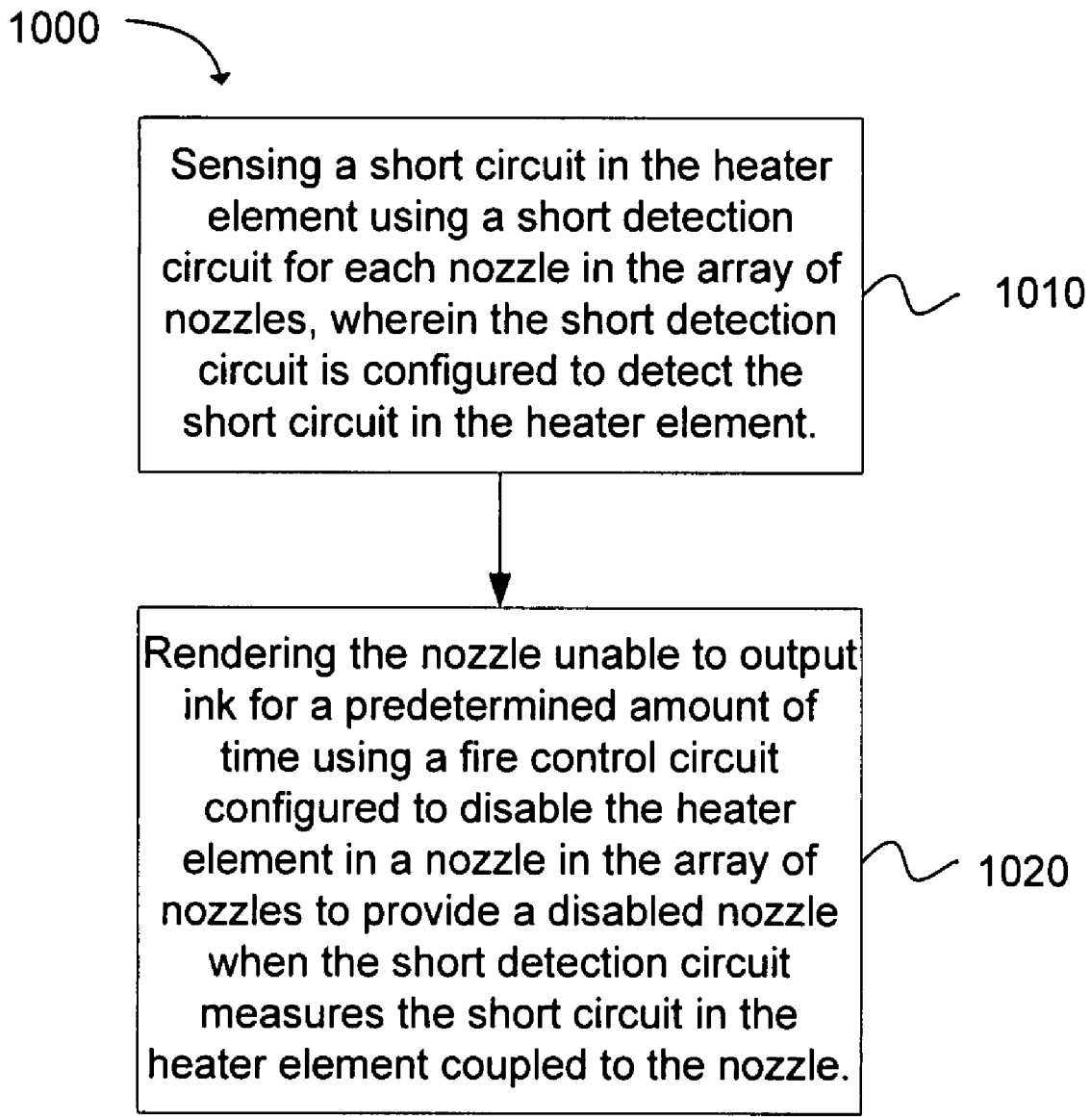
FIG. 10 is a flow chart depicting a method for disabling a single nozzle in a thermal ink-jet print head having an array of nozzles in accordance with an embodiment of the present disclosure.

In another embodiment, a short scanning circuit 902 can be incorporated with the short detection circuit 104 and the fire control circuit 106, as shown in FIG. 9. The short scanning circuit can be used to report short circuited heater resistors to the printer or software controlling the printer. For example, all of the fire control latches 302 (FIG. 3) in the fire control circuitry can be set to a digital high. All of the heater resistors can then be fired. Any of the latches that are shorted will be reset by their associated short detection circuit 104 to a digital low. The data contained in the fire control latches 302 (FIG. 3) can be scanned and analyzed using software or hardware to determine which latches were reset. This information can be used to determine when the print head may benefit from cleaning to remove excess ink or other detritus.

Additionally, when nozzles have been disabled, adjacent nozzles can be used to compensate and output ink for the disabled nozzle(s) to enable the output of the print head to appear as if there are no defective nozzles. The ability to compensate for disabled nozzles using adjacent nozzles enables a print job to be finished even if a significant number of the nozzles are shorted. Further, the short detection circuit can enable each shorted heater resistor to be turned off before significant damage is done to the heater resistor, the print head, or the surrounding circuitry, while enabling the print head to continue to be used.

Another embodiment provides a method for disabling a single nozzle in a thermal inkjet print head. The print head can include an array of nozzles, with a plurality of the nozzles each being coupled to a heater resistor. The method includes the operation of sensing 1010 a short circuit in the heater resistor using a short detection circuit for each nozzle in the array of nozzles, wherein the short detection circuit is configured to detect a short circuit in the heater element.

An additional operation of the method 1000 involves rendering 1020 the nozzle unable to output ink for a predetermined amount of time using a fire control circuit configured to disable the heater element in a nozzle in the array of nozzles to provide a disabled nozzle when the short detection circuit measures a short circuit in the heater element coupled to the nozzle. The predetermined amount of time can be a single pass of the printer head, less than a single pass of the printer head, more than a single pass of the printer head, or permanently. As previously discussed, the short circuit that is sensed in one or more heater elements may be temporary in nature. Each heater element in the array of nozzles in the print head may be checked for a short circuit each time the associated nozzle is fired.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A nozzle disable system, comprising:

a thermal ink-jet print head having an array of nozzles;

a heater element coupled to a single nozzle in the array of nozzles;

a short detection circuit for the heater element, wherein the short detection circuit is configured to detect a short circuit in the heater element; and a fire control circuit configured to disable the heater element to provide a single disabled nozzle for a predetermined amount of time when the short detection circuit measures a short circuit in the heater element coupled to the single nozzle in the array of nozzles.

2. A system as in claim 1, wherein the heater element is a heater resistor configured to heat ink in a nozzle.

3. A system as in claim 2, wherein the short detection circuit comprises a current sense resistor configured to measure a current level in the heater resistor to detect the short circuit.

4. A system as in claim 2, wherein the short detection circuit comprises a voltage divider configured to sense a voltage on a high side of the heater resistor.

5. A system as in claim 4, wherein the voltage divider is comprised of first and second metal oxide semiconductors coupled to an amplifier to form a tuned inverter.

6. A system as in claim 1, wherein the fire control circuit includes a data latch configured to enable the heater element to be switched on and off.

7. A system as in claim 1, wherein a separate short detection circuit is coupled to each heater element in the array of nozzles and each short detection circuit is configured to detect a short of each heater element in the array of nozzles each time the nozzle is fired.

8. A system as in claim 1, further comprising a short scanning circuit configured to report a short circuit status of each heater element.

9. A system as in claim 1, wherein the short detection circuit and the fire control circuit are located on the print head.

10. A system as in claim 1, wherein the short detection circuit and the fire control circuit are electrically coupled to the print head.

11. A system as in claim 1, wherein the fire control circuit is configured to substantially reduce current to approximately zero mA in the heater element within less than 100 nanoseconds when a short circuit is detected in the short detection circuit.

12. A method for disabling a single nozzle in a thermal ink-jet print head having an array of nozzles, with a plurality of the nozzles each being coupled to a heater element, the method comprising:

sensing a short circuit in the heater element using a short detection circuit for each nozzle in the array of nozzles, wherein the short detection circuit is configured to detect the short circuit in the heater element; and rendering the nozzle unable to output ink for a predetermined amount of time using a fire control circuit configured to disable the heater element in a nozzle in the array of nozzles to provide a disabled nozzle when the short detection circuit measures the short circuit in the heater element coupled to the nozzle.

13. A method as in claim 12, further comprising sensing the short circuit in the heater element using the short circuit detection circuit comprising a current sense element.

14. A method as in claim 12, further comprising sensing the short circuit in the heater element using the short circuit detection circuit comprising a voltage divider.

15. A method as in claim 12, further comprising reporting any disabled heater elements in the array of nozzles using a short scanning circuit.

16. A method as in claim 12, further comprising compensating for the disabled nozzle by emitting ink from an adjacent nozzle in the array of nozzles.

17. A method as in claim 12, further comprising attaching the short detection circuit and the fire control circuit to the thermal ink-jet print head.

18. A method as in claim 12, further comprising electrically coupling the short detection circuit and the fire control circuit to print head.

19. A method as in claim 12, further comprising substantially reducing current to approximately zero milliamps in the heater element in less than 100 nanoseconds when the short circuit is detected with the short detection circuit.

20. A system for disabling a single nozzle in a thermal ink-jet print head having an array of nozzles, with a plurality of the nozzles each being coupled to a heater element, the method comprising:

a means for sensing a short circuit in the heater element using a short detection circuit for each nozzle in the array of nozzles, wherein the short detection circuit is configured to detect the short circuit in the heater element; and a means for rendering the nozzle unable to output ink for a predetermined amount of time using a fire control circuit configured to disable the heater element in the nozzle in the array of nozzles to provide a disabled nozzle when the short detection circuit measures the short circuit in the heater element coupled to the nozzle.

21. A system as in claim 20 wherein the short detection circuit further comprises a means for measuring current in the heater element.

22. A system as in claim 20, wherein the short detection circuit further comprises a means for measuring voltage in the heater element.

* * * * *